US010882202B2

(12) United States Patent
Morris et al.

(10) Patent No.: US 10,882,202 B2
(45) Date of Patent: Jan. 5, 2021

(54) PANEL FORMING ASSEMBLY

(71) Applicant: Kingspan Insulated Panels, Inc., Deland, FL (US)

(72) Inventors: Gabriel Morris, Aurora (CA); Mat Murray, Aurora (CA); Brian Glancy, Toronto (CA)

(73) Assignee: Kingspan Insulated Panels, Inc., Deland, FL (US)

( * ) Notice: Subject to any disclaimer, the term of this patent is extended or adjusted under 35 U.S.C. 154(b) by 146 days.

(21) Appl. No.: 15/364,517

(22) Filed: Nov. 30, 2016

(65) Prior Publication Data

US 2017/0174434 A1 Jun. 22, 2017

Related U.S. Application Data

(60) Provisional application No. 62/261,538, filed on Dec. 1, 2015.

(51) Int. Cl.
*B26D 5/08* (2006.01)
*B21D 5/08* (2006.01)
*E04C 2/292* (2006.01)

(52) U.S. Cl.
CPC ..... *B26D 5/08* (2013.01); *B21D 5/08* (2013.01); *E04C 2/292* (2013.01)

(58) Field of Classification Search
CPC ..... Y10T 83/0207; Y10T 83/0222; Y10T 83/7083; B31B 50/26; B31B 50/16; B23Q 11/02; B27B 15/06; B26D 5/08
See application file for complete search history.

(56) References Cited

U.S. PATENT DOCUMENTS 3,806,389 A * 4/1974 Gwynne ..... B28B 11/00 156/202
3,905,621 A * 9/1975 DeMarco ..... C03B 33/02 285/7
3,924,496 A * 12/1975 DerMarderosian .... B26D 3/006 409/304
4,385,090 A * 5/1983 Sims ..... B29C 63/04 428/121
4,612,837 A * 9/1986 Gendron ..... B23Q 11/02 83/790
4,614,138 A * 9/1986 Altman ..... B26D 1/24 125/23.02
4,779,500 A * 10/1988 Bennett ..... B26D 7/0006 83/174

(Continued)

FOREIGN PATENT DOCUMENTS

CA 2453690 A1 * 6/2004 ..... B31B 50/00

*Primary Examiner* — Jonathan G Riley
(74) *Attorney, Agent, or Firm* — Harness, Dickey & Pierce, P.L.C.

(57) ABSTRACT

A panel forming station has a frame, a pair of clamping devices and a pair of end forming devices. A panel is clamped between one clamping device and the frame. The first forming device forms a first trimless end on the panel. The first forming device has a cutter bending blade and a roller that forms the first trimless end. The second clamping device clamps a panel. The second forming device has a cutter, a bending blade and a roller to form the second trimless end. A controller couples with the first and second clamping device and first and second end forming devices to control the panel's passage through the frame.

8 Claims, 7 Drawing Sheets

(56) References Cited

U.S. PATENT DOCUMENTS

| | | | | | |
|---|---|---|---|---|---|
| 5,246,516 | A * | 9/1993 | Rias | B29C 43/28 | 156/202 |
| 5,466,211 | A * | 11/1995 | Komarek | B26D 7/27 | 156/257 |
| 5,690,601 | A * | 11/1997 | Cummings | B31F 1/0012 | 493/340 |
| 6,159,327 | A * | 12/2000 | Forkert | B26D 1/305 | 156/256 |
| 6,655,434 | B2 * | 12/2003 | Danko | B29C 67/0044 | 156/204 |
| 8,647,250 | B2 * | 2/2014 | French | B31D 3/04 | 493/344 |
| 2003/0209410 | A1 * | 11/2003 | Itoh | B65G 43/10 | 198/781.05 |
| 2005/0000337 | A1 * | 1/2005 | Ahne | B26D 7/26 | 83/76.1 |
| 2008/0184760 | A1 * | 8/2008 | Carsley | B21D 39/023 | 72/306 |
| 2009/0205387 | A1 * | 8/2009 | Durney | B21D 5/083 | 72/178 |
| 2010/0247849 | A1 * | 9/2010 | Depaoli | B26D 3/085 | 428/116 |
| 2013/0337990 | A1 * | 12/2013 | French | B31D 3/04 | 493/352 |
| 2015/0114198 | A1 * | 4/2015 | Gallucci | B26D 3/06 | 83/613 |

* cited by examiner

PANEL FORMING ASSEMBLY

CROSS-REFERENCE TO RELATED APPLICATION

This application claims the benefit of U.S. Provisional Application No. 62/261,538, filed on Dec. 1, 2015. The entire disclosure of the above application is incorporated herein by reference.

FIELD

The present disclosure relates to composite insulation panels with an inner and outer sheet sandwiching a body of insulation and, more particularly, to an assembly for forming panels with trimless ends.

BACKGROUND

Insulated panels are well known. They are utilized for walls and roof panels in buildings. The building is built by connecting panels together as well as securing the panels onto a framing structure. The panels may have lengths varying from 6 to 40 feet. Additionally, the width may vary between 6 inches to 48 inches. The panel thickness varies between 2 to 4 inches. The panels are formed to have desired characteristics. However, when forming the panels, it has not been possible to form the panels in a totally automated process. Thus, several steps of forming the panels have been conducted manually.

Accordingly, it is desirable to have a device that enables the panels to be formed by an automated process. This eliminates the manual steps and provides a faster and dependable operation.

Accordingly, the present disclosure provides the art with a panel forming assembly that carries out an automated process. The present disclosure provides a panel forming station that carries out the automated process. The present disclosure provides a panel formed by an entirely automated process.

SUMMARY

According to a first object of the disclosure, a panel forming station comprises a frame. The frame includes a clamping device to clamp panels between the clamping device and the frame. A device for forming a first trimless end on the panels is movably coupled with the frame. A second clamping device to clamp panels between the clamping device and the frame is coupled with the frame. A device to form a second trimless end on the panels is coupled with the frame. A controller is coupled with the first and second clamping device and first and second trimless end forming devices. The controller enables the panels to pass through the frame and form a first and second trimless end on the panel. A further device is coupled with the frame to remove waste material. First and second tables are positioned on the frame. The tables enable the first and second clamping devices to clamp the panel between the clamping devices and the tables.

According to a second aspect of the disclosure, a panel forming assembly comprises a first conveyor and a panel forming station associated with the first conveyor to receive a panel flow. The panel forming station comprises a frame. The frame includes a clamping device for clamping a panel between the clamping device and the frame. A device for forming a first trimless end on the panel is coupled with the frame. A second clamping device for clamping a panel between the clamping device and the frame is coupled with a frame. A device to form a second trimless end on the panel is coupled with the frame. A controller is coupled electrically with the first and second clamping devices and first and second trimless end forming devices. The controller enables the panel to pass through the frame and form a first and second trimless end on the panel. A further device is coupled with the frame to remove waste material. First and second tables are positioned on the frame. The tables enable the first and second clamping devices to clamp the panel between the clamping devices and the tables. A second conveyor is associated with the panel forming station to receive a formed panel.

According to a third aspect of the disclosure, a method of forming a panel comprises providing a panel forming station and entering a panel flow into the station. Moving the panel a desired distance into a frame. Clamping the panel with a first clamping mechanism. Cutting the panel and forming a first trimless end on the panel. Releasing the panel from the first clamping mechanism and moving it through the frame to a clamping position in a second clamping mechanism. Cutting the panel and forming a second trimless end on the panel. Releasing the panel from the second clamping mechanism and ejecting the finished panel from the frame.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Example embodiments will now be described more fully with reference to the accompanying drawings.

Figure 1:
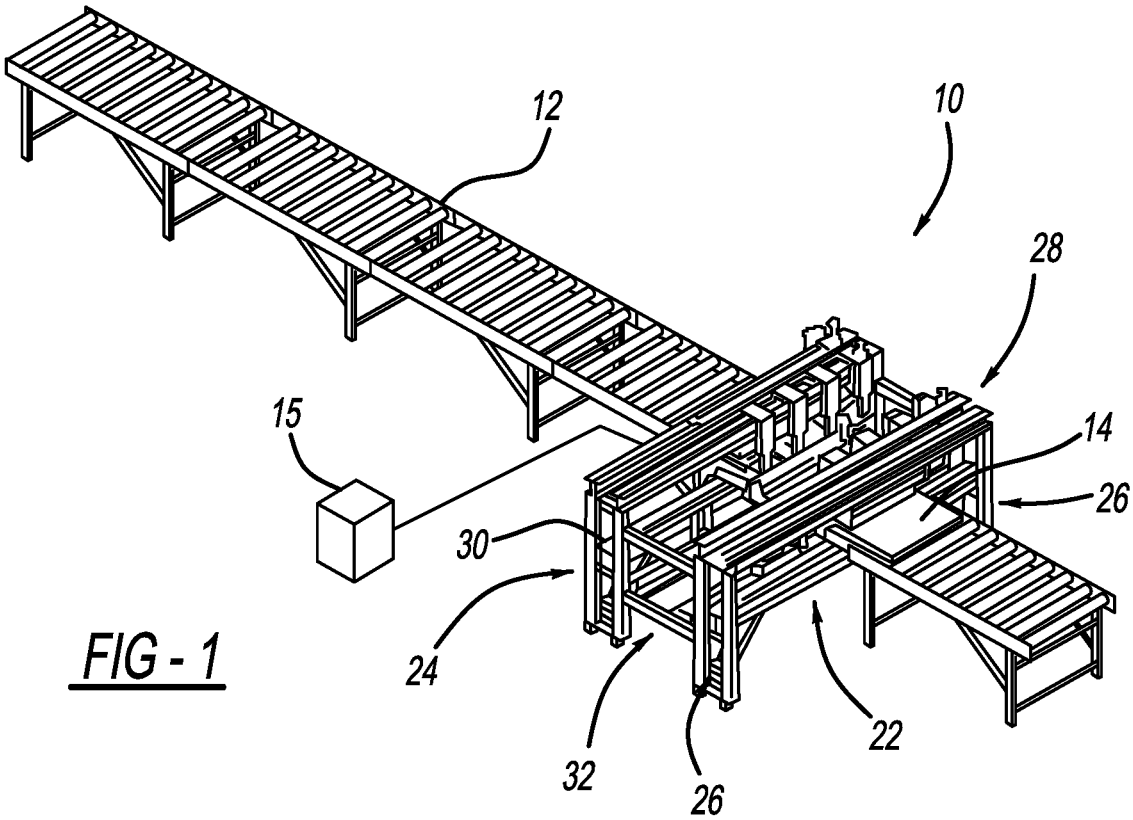
FIG. 1 is a perspective view of a conveyor system with a panel forming station.
Figure 2:
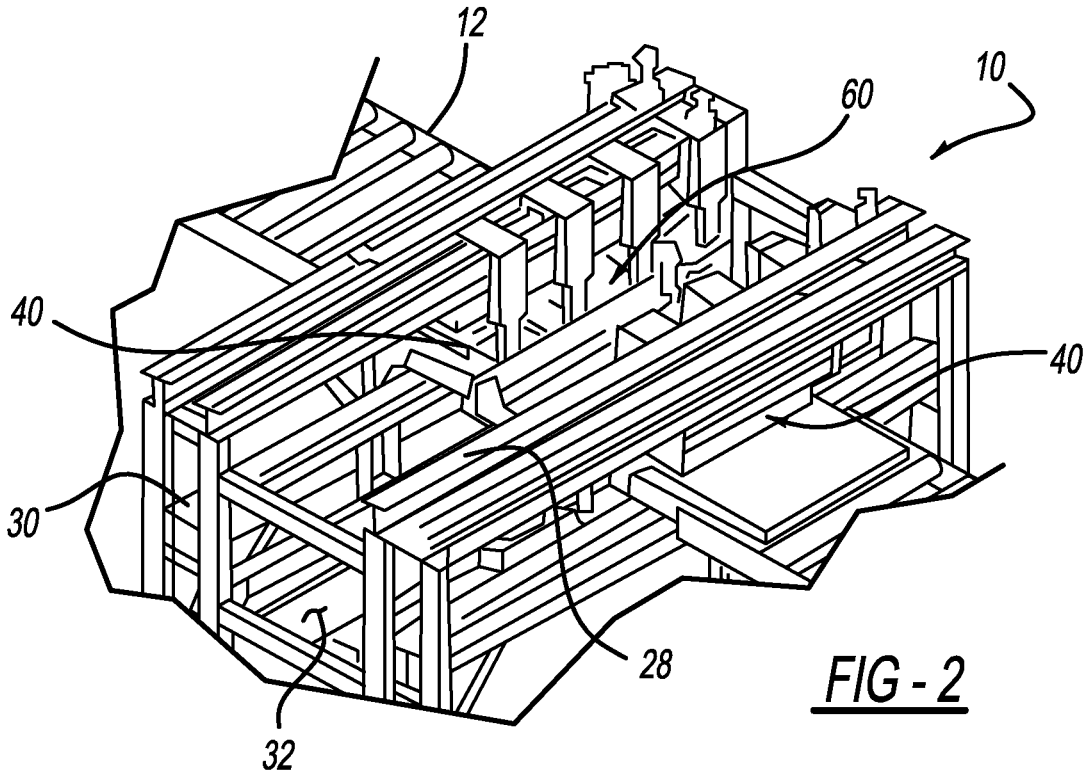
FIG. 2 is an enlarged perspective partial view of the panel forming station of FIG. 1.
Figure 3:
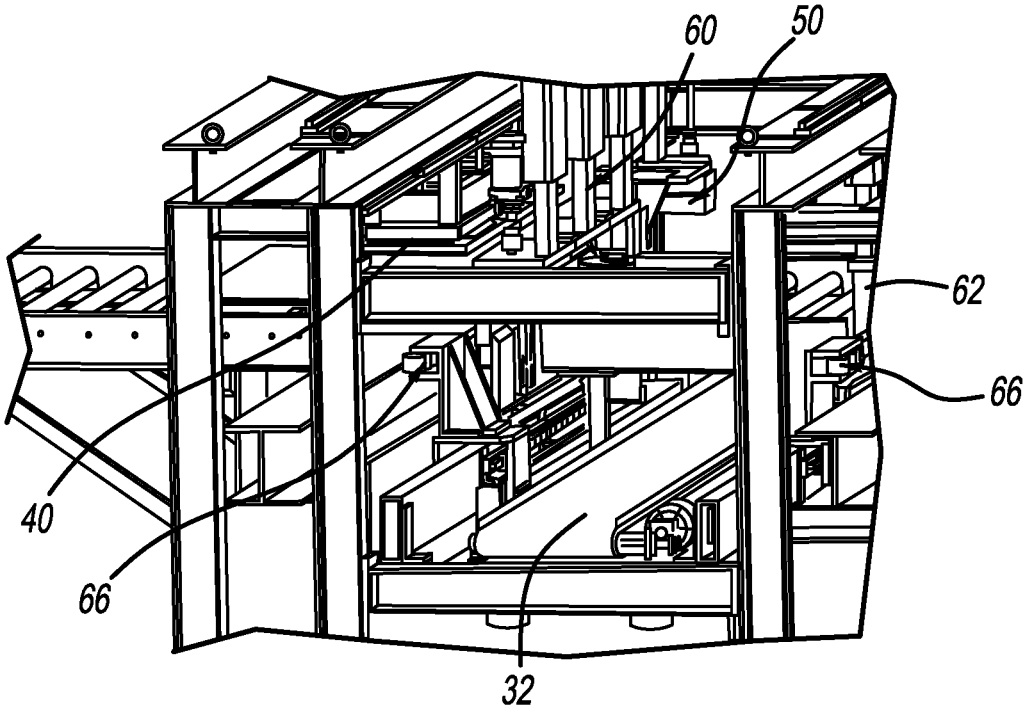
FIG. 3 is an enlarged partial perspective view of the panel forming station of FIG. 1.
Figure 4:
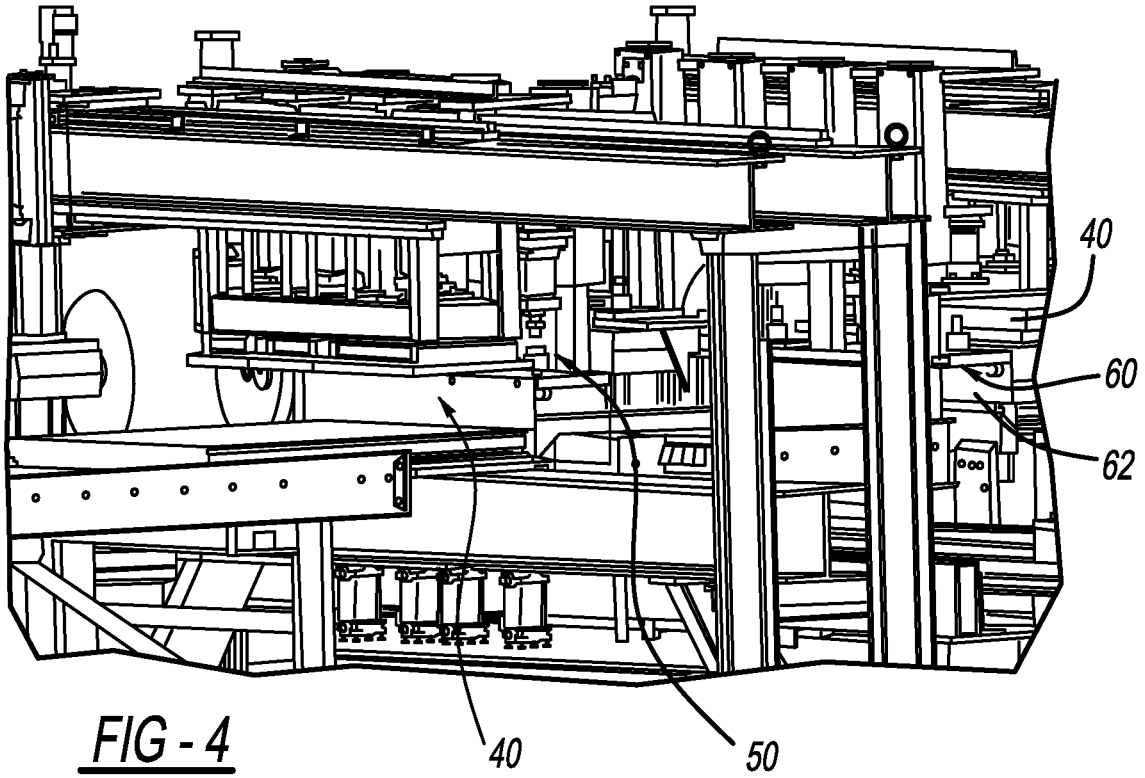
FIG. 4 is an enlarged partial perspective view of the panel forming station of FIG. 1.
Figure 5:
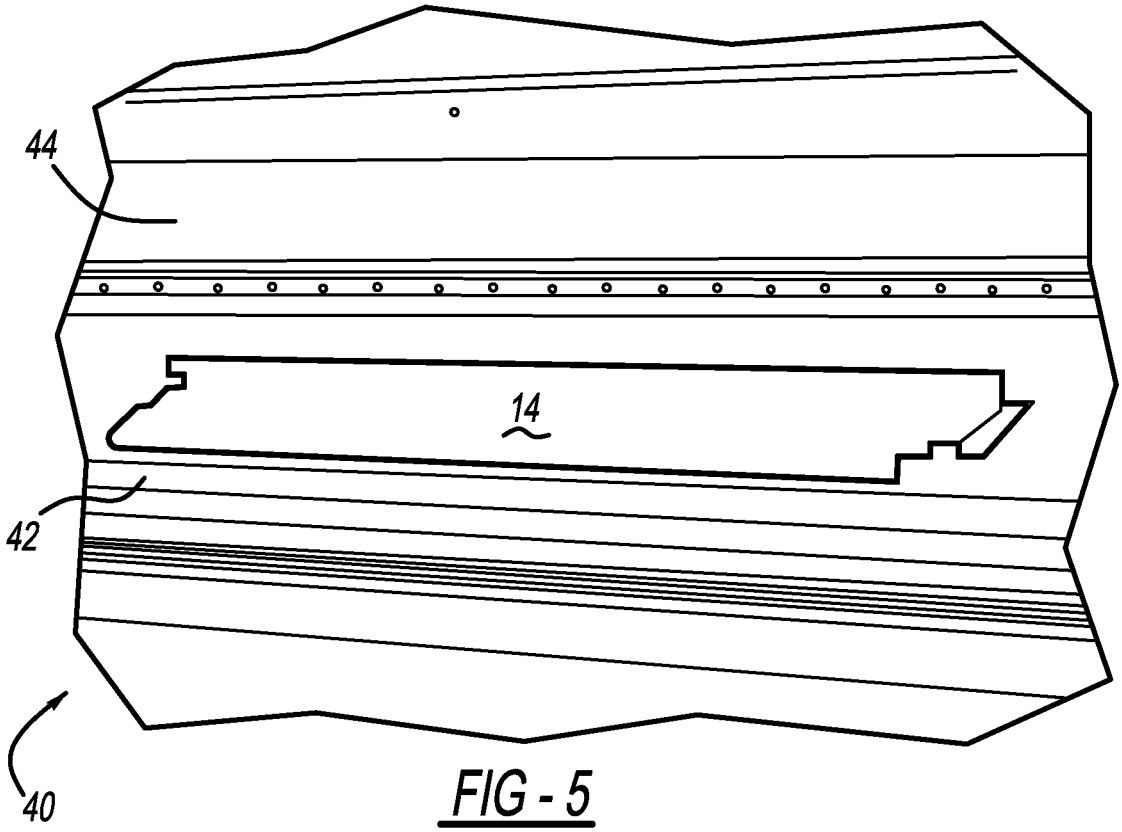
FIG. 5 is an elevation view of a clamping assembly.
Figure 6:
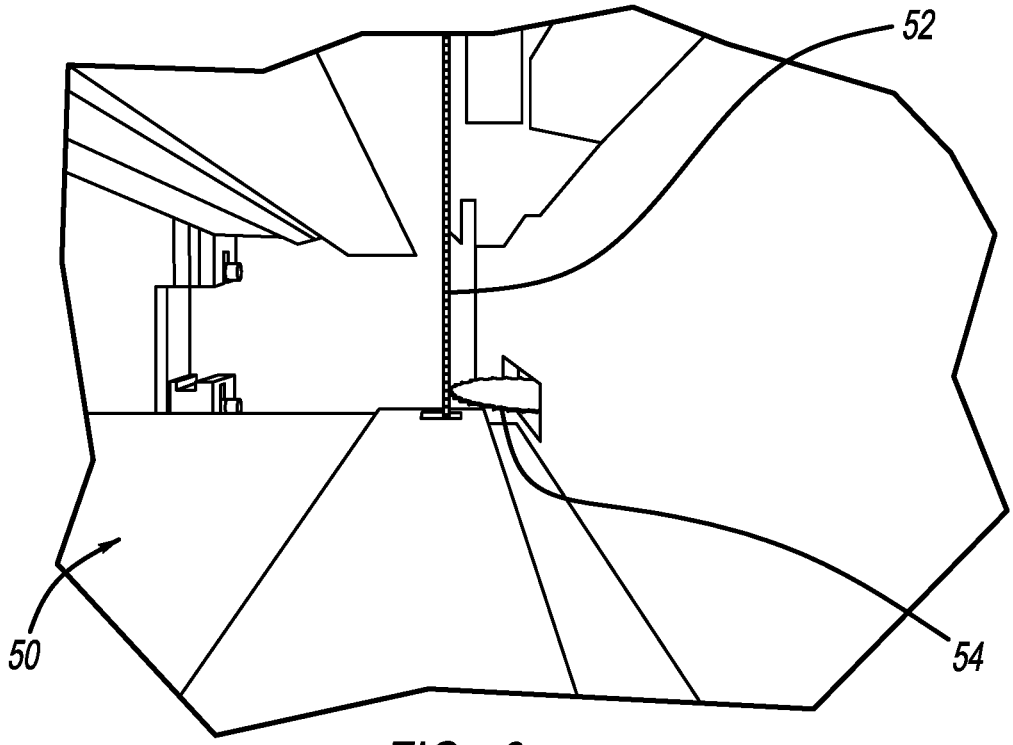
FIG. 6 is an elevation view of the cutting assembly.
Figure 7:
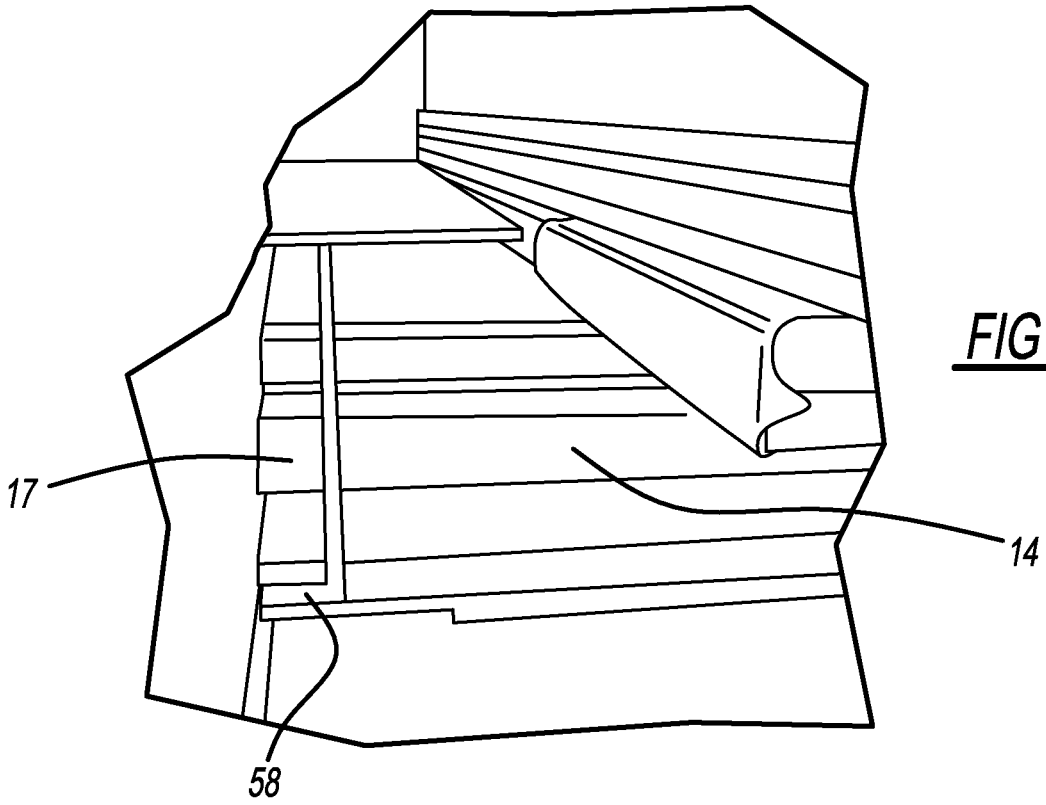
FIG. 7 is an elevation view with the unwanted panel portion.
Figure 8:
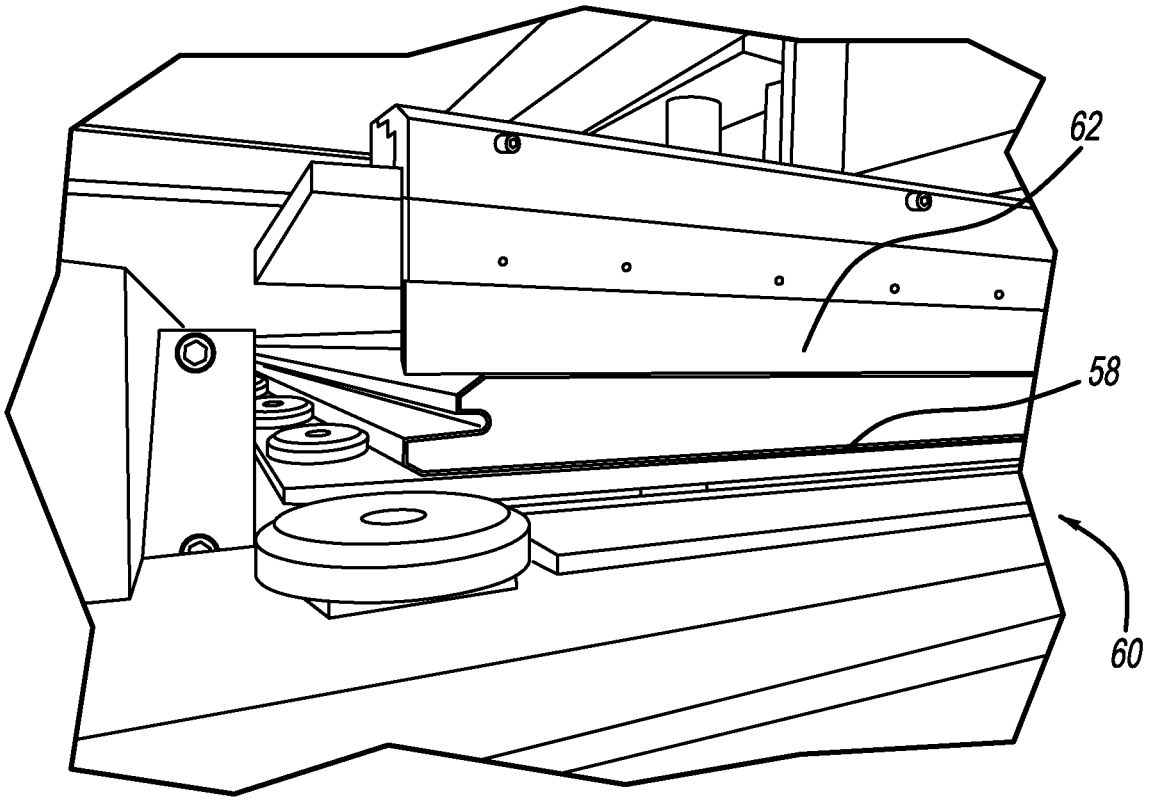
FIG. 8 is a perspective view of a forming mechanism.

Turning to FIG. 1, a panel forming station is illustrated and designated with the reference numeral 10. A conveyor 12 delivers panels 14, cut to size, to the panel forming station 10. The panels 14 are of a desired width and length and are moved along the conveyor 12 into the panel forming station 10.

The forming station 10 includes a frame 20 with a pair of substantially identical sides 22, 24. The sides 22, 24 include legs 26 that support cross beams 28, 30. A waste conveyor system 32 is positioned between the sides 22, 24. The waste conveyor system 32 enables removal of panel waste portions 15 that are removed from the panels 14 during the panel end forming process. The waste conveyor system 32 moves the waste portions out of the forming station for disposal.

A clamping mechanism 40 is coupled with the cross beams 28, 30. The clamping mechanism 40 includes a table 42 and a moving clamp member 44. The table 42 enables the panel 14 to rest on the table 42. When the moving clamp member 44 contacts the panel 14, it is securely held in place between the moving clamp member 44 and table 42.

A cutting mechanism 50 is secured with and movable on the cross members 30. The cutting mechanism 50 includes a vertical cutting blade 52 and a horizontal cutting blade 54. The cutting blades 52, 54 operate simultaneously to remove an unwanted panel portion 17 from the panel 14 in order to enable forming of a trimless end panel. The cutting mechanism 50 moves along the cross member 30 cutting the panel 14 until the unwanted portion 17 is severed from the panel 14. The unwanted portion 17 drops from the panel 14 onto the conveyor 32 and is removed from the forming station 10.

Figure 9:
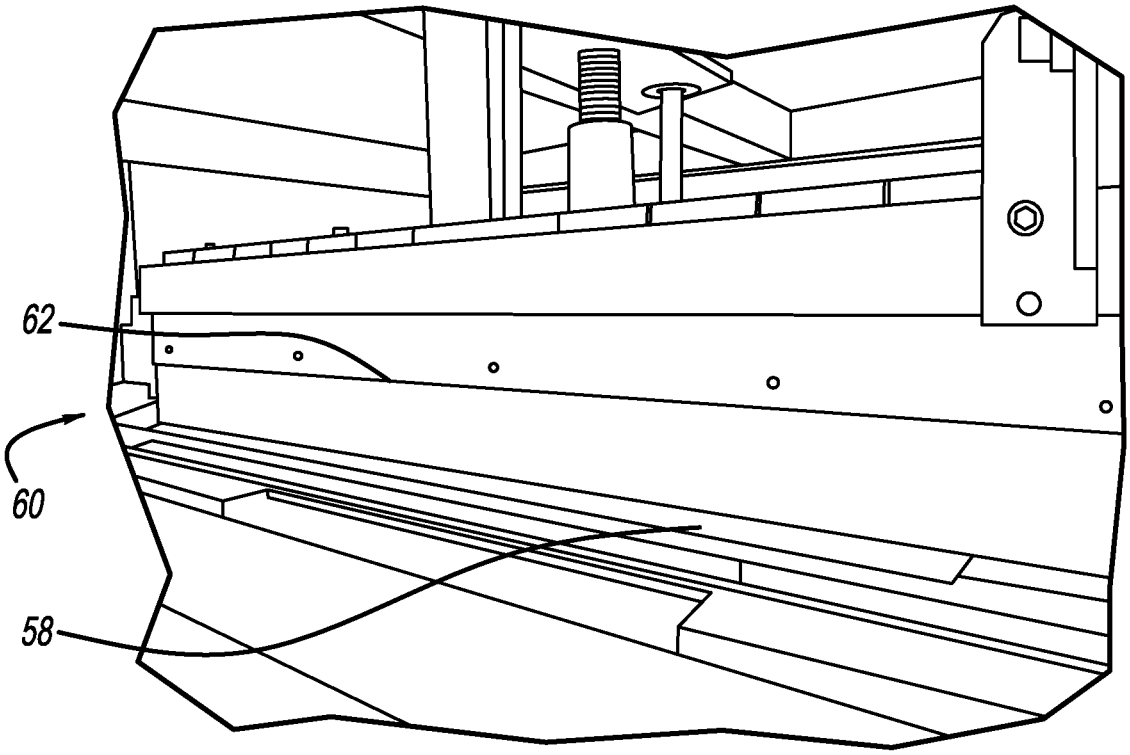
FIG. 9 is a view like FIG. 8 in a second position.
Figure 10:
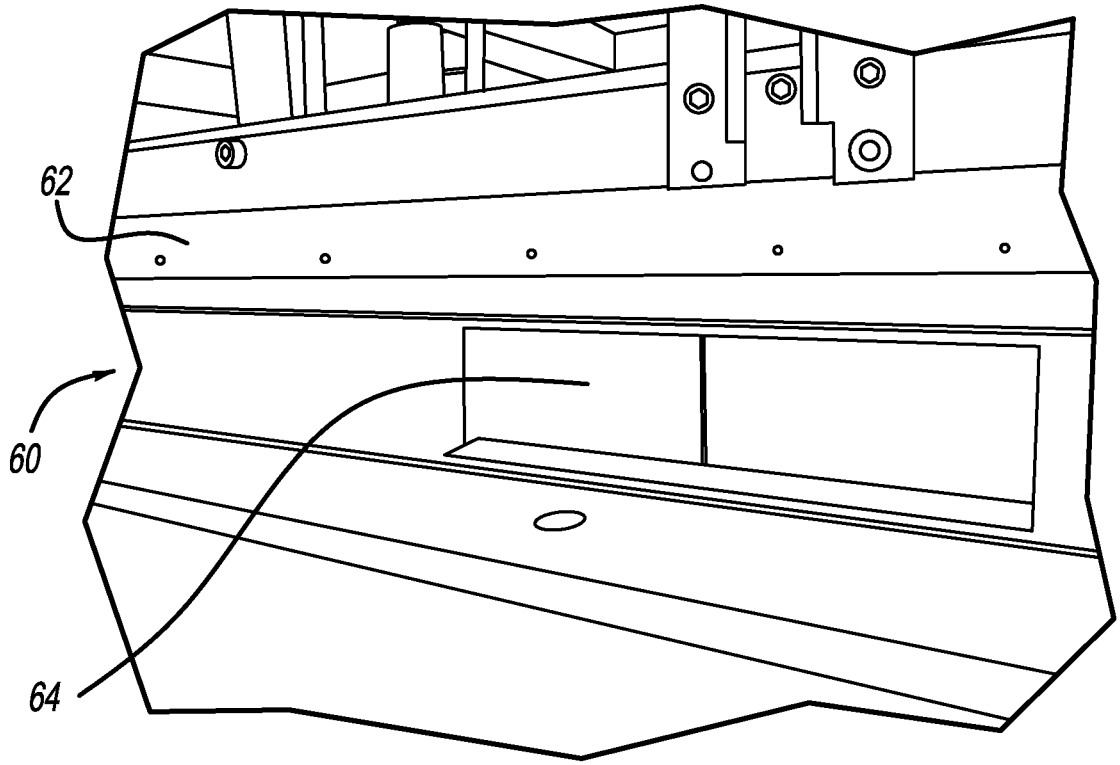
FIG. 10 is a perspective view of the forming assembly in a second position.
Figure 11:
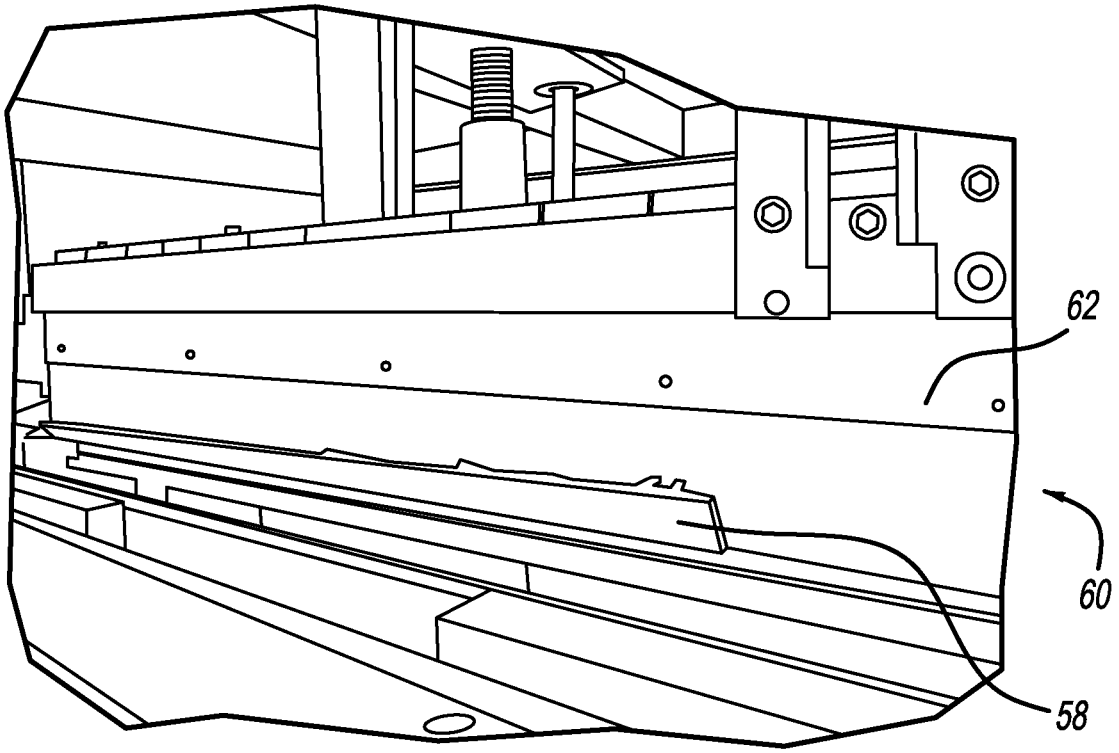
FIG. 11 is a perspective view of the forming assembly with a bent flange.
Figure 12:
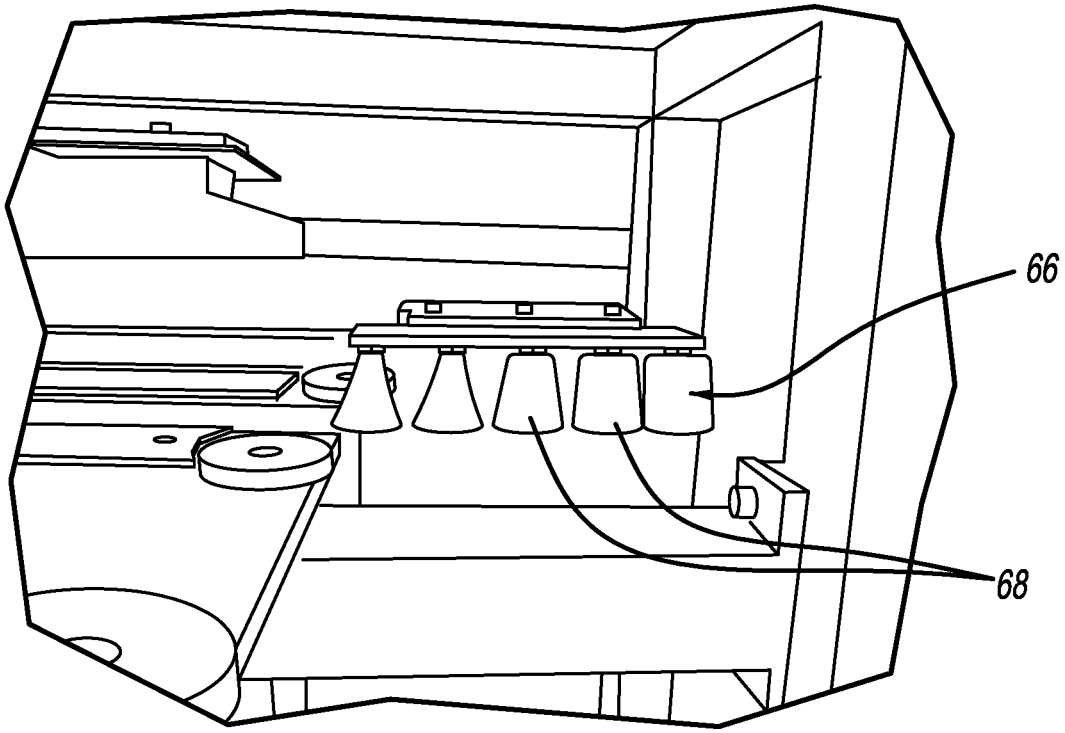
FIG. 12 is a perspective view of the roller assembly.
Figure 13:
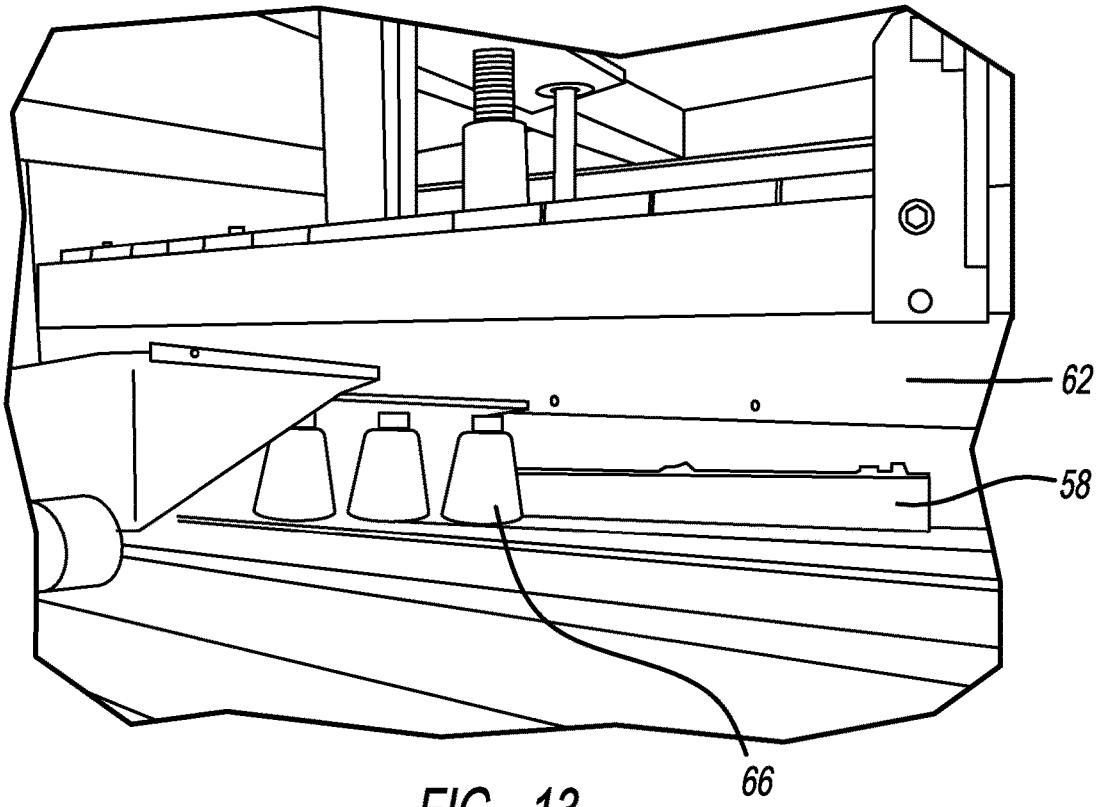
FIG. 13 is a perspective view of the roller assembly performing a bend on the flange.
Figure 14:
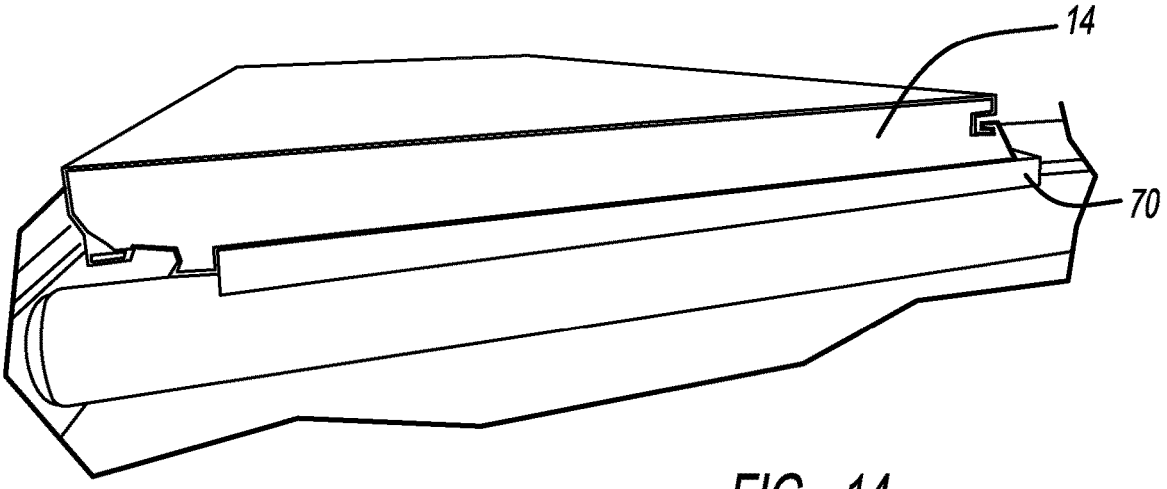
FIG. 14 is a perspective view of a panel with a finished end.

A first forming mechanism 60 is coupled with the cross beam 28. The first metal forming mechanism 60 includes a blade clamp 62 and a folding blade 64. The clamp blade 62 moves perpendicular to the end of the panel 14 until it comes in contact with the remaining portion 58 of the panel 14. The clamping blade 62 clamps against the remaining panel portion 58 holding it in position. The folding blade 64 moves toward the clamping blade 62 bending or forming an edge or first fold on the metal skin of the remaining portion 58. The first fold is at an acute angle with respect to the clamping blade 62 (see FIG. 9). A roller 66 moves along the cross beam 30 against the folded remaining portion 58 of the panel 14. The roller 66, including a plurality of rollers 68, contacts the bent remaining portion 58 of the panel 14. The rollers 68 contact the bent metal remaining portion 58, bending the remaining portion 58. This bends the remaining portion 58 so that it is transverse with respect to the axis of the panel 14. Accordingly, the end of the panel 14 is formed by an automated panel forming process to form a trimless end 70 on the first end of the panel 14.

The panel 14 is then moved along the conveyor 12 to the second side 26 of the station 10. As the second end of the panel 14 approaches the frame second side 22, a controller slows movement of the panel 14. The panel 14 reaches the side 22 wherein the panel 14 is clamped by a second clamping mechanism 40. The second end is cut, bent and finally formed with a transverse bend, as described above, by the second clamping mechanism 40, cutting mechanism 50, second forming member 60 and rollers 66 as described above. Thus, the second end of the panel includes a trimless end 70 like that of the first end of the panel.

A process for forming a panel 14 with trimless ends includes providing a panel 14 with a desired width and length and positioning the panel onto the conveyor 12. A sensor senses the first end of the panel 14 approaching the first side 22 of the forming station 10. The sensor sends a signal to a controller 15 which, in turn, stops movement of the panel 14 on the conveyor 12. The first clamping mechanism 40 clamps the panel 14 between the clamping member 44 and table 42. The cutting mechanism 50 cuts a vertical as well as a horizontal cut into the end of the panel 14. The blades 52, 54 operate simultaneously to cut the panel 14 such that an unwanted panel portion 15 is removed from the first end 16 of the panel 14. The first end 16 of the panel 14, clamped by the clamping mechanism 40, enables a first forming mechanism 60 to begin forming the remaining portion 58 of the panel 14. Clamping blade 62 moves into contact with the remaining portion 58 of the panel 14. A folding blade 64 moves in a direction opposite to the clamping blade 62. The clamping blades 62, 64 bend the metal remaining portion 58 into a flange with an acute angle with respect to the first end 16 of the panel 14. Roller 66 is moved along the cross beam 30 to finish bending the flange to be at a 90° angle or transverse with respect to the longitudinal axis of the panel 14. Thus, a trimless end portion is formed on the first end 16 of the panel 14 by an automated process.

The controller 15 then moves the panel 14 to the second side 22 of the station 10. A sensor senses the second end 18 of the panel 14 coming into position at the second side 22 of the station 10. As this occurs, the controller stops movement of the panel 14 and initiates clamping of the second clamping mechanism 40. The clamping, cutting and bending occurs like that described above on the second end 18 of the panel 14. Thus, the second end 18 of the panel 14 is likewise formed with a trimless end.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A panel forming station comprising:

a frame defining an axis so that panels move axial along the frame;

a first clamp for clamping and securely holding a panel in place between the first clamp and the frame, the first clamp coupled with the frame;

a first trimless end forming assembly for forming a first trimless end on the panel coupled with the frame, the first trimless end forming assembly forming the first trimless end of the panel while the panel is statically held in place by the first clamp, the first trimless end forming assembly including a cutting mechanism for removing a waste portion of the panel, a forming mechanism for bending a remaining portion on the panel, and a roller moving with respect to the frame along the first end of the panel from one side of the panel to another, the roller exerting a force in an axial direction onto the panel to complete the forming of the first trimless end;

a second clamp for clamping and securely holding the panel between the second clamp and the frame;

a second trimless end forming assembly for forming a second trimless end on the panel coupled with the frame, the second trimless end forming assembly forming the second trimless end on the panel while the panel is statically held in place by the second clamp, the second trimless end forming assembly including a cutting mechanism for removing a waste portion of the panel, a forming mechanism for bending a remaining portion on the panel, and a roller completing the forming of the second trimless end; and a controller coupled with the first and second clamps, and first and second trimless end forming assemblies for enabling the panel to pass through the frame and form the first and second trimless ends on the panel.

2. The panel forming station of claim 1, further comprising a conveyor for removing the waste portion coupled with the frame.

3. The panel forming station of claim 1, further comprising a first table on the frame, the first table positioned with respect to the first clamp so that the panel is clamped between the first clamp and first table.

4. The panel forming station of claim 3, further comprising a second table on the frame, the second table positioned with respect to the second clamp so that the panel is clamped between the second clamp and second table.

5. A panel forming assembly comprising:

a first conveyor defining an axis so that panels move axial along the conveyor;

a panel forming station associated with the first conveyor to receive a panel flow;

the panel forming station comprising a frame;

a first clamp for clamping and securely holding a panel in place between the first clamp and the frame, the first clamp coupled with the frame;

a first trimless forming assembly forming a first trimless end on the panel coupled with the frame, the first trimless forming assembly forming the first trimless end of the panel while the panel is statically held in place by the first clamp, the first trimless end forming assembly including a cutting mechanism for removing a waste portion of the panel, a forming mechanism for bending a remaining portion on the panel, a roller moving with respect to the frame along the first end of the panel from one side of the panel to another, the roller exerting a force in an axial direction onto the panel to complete the forming of the first trimless end;

a second clamp for clamping and securely holding the panel between the second clamp and the frame;

a second trimless end forming assembly for forming a second trimless end on the panel movably coupled with the frame, the second trimless end forming assembly forming the second trimless end on the panel while the panel is statically held in place by the second clamp, the second trimless end forming assembly including a cutting mechanism for removing a waste portion of the panel, a forming mechanism for bending a remaining portion on the panel, and a roller completing the forming of the second trimless end;

a controller coupled with the first and second clamps, and first and second trimless end forming assemblies for enabling the panel to pass through the frame and forming a first and second trimless end on the panel; and a second conveyor associated with the panel forming station for receiving a formed panel.

6. The panel forming station of claim 5, further comprising a conveyor for removing waste material coupled with the frame.

7. The panel forming station of claim 5, further comprising a first table on the frame, the first table positioned with respect to the first clamp so that the panel is clamped between the first clamp and first table.

8. The panel forming station of claim 7, further comprising a second table on the frame, the second table positioned with respect to the second clamp so that the panel is clamped between the second clamp and second table.

* * * * *